United States Patent [19]

Wozniacki

[11] 4,417,686

[45] Nov. 29, 1983

[54] OCTAGON TRAY WITH REINFORCED HANDHOLE

[75] Inventor: Roger M. Wozniacki, Charlotte, N.C.

[73] Assignee: International Paper Company, New York, N.Y.

[21] Appl. No.: 470,688

[22] Filed: Feb. 28, 1983

[51] Int. Cl.[3] ..... B65D 5/46; B65D 5/26

[52] U.S. Cl. ..... 229/52 B; 229/16 R; 229/31 FS

[58] Field of Search ..... 229/52 B, 16 R, 6 R, 229/32 R, 34 R, 31 FS

[56] References Cited

U.S. PATENT DOCUMENTS

| | | | |
|---|---|---|---|
| 55,709 | 6/1866 | Reese . | |
| 1,271,033 | 7/1918 | Hall . | |
| 1,653,116 | 12/1927 | Parks . | |
| 1,948,083 | 2/1934 | Warner . | |
| 2,377,989 | 6/1945 | Braun . | |
| 2,568,204 | 9/1951 | Reeser . | |
| 2,800,893 | 7/1957 | Norman . | |
| 3,511,429 | 5/1970 | Brian | 229/31 FS |
| 3,533,547 | 10/1970 | Houston | 229/34 R |
| 3,547,337 | 12/1970 | Pisarzuk | 229/52 B |
| 3,659,774 | 5/1972 | Mielke | 229/52 B |
| 3,670,948 | 6/1972 | Berg . | |

*Primary Examiner*—Herbert F. Ross

*Attorney, Agent, or Firm*—Thomas J. Greer, Jr.; Walt T. Zielinski

[57] ABSTRACT

A tray and one-piece blank for forming it. The tray is formed of corrugated paperboard and includes bottom, side and end wall panels. The side wall panels carrying extensions at their upper end portions, these extensions are wrapped around the end panels for reinforcement. The end panels carry extensions which are bent and positioned interiorly along the side walls, one of the extensions serving as a corner reinforcement against buckling under vertical loads.

7 Claims, 4 Drawing Figures

OCTAGON TRAY WITH REINFORCED HANDHOLE

This invention relates to a tray and blank for forming it. The tray is formed of stiff, resilient and foldable material such as corrugated paperboard. The one-piece blank from which the tray is formed is provided with both cut lines and score lines, the latter lines serving as hinge axes about which to bend the panels which define the tray. IN THE DRAWINGS FIG. 1 is a plan view of a blank from which the tray of this invention is fashioned, according to a first embodiment.

Figure 1:
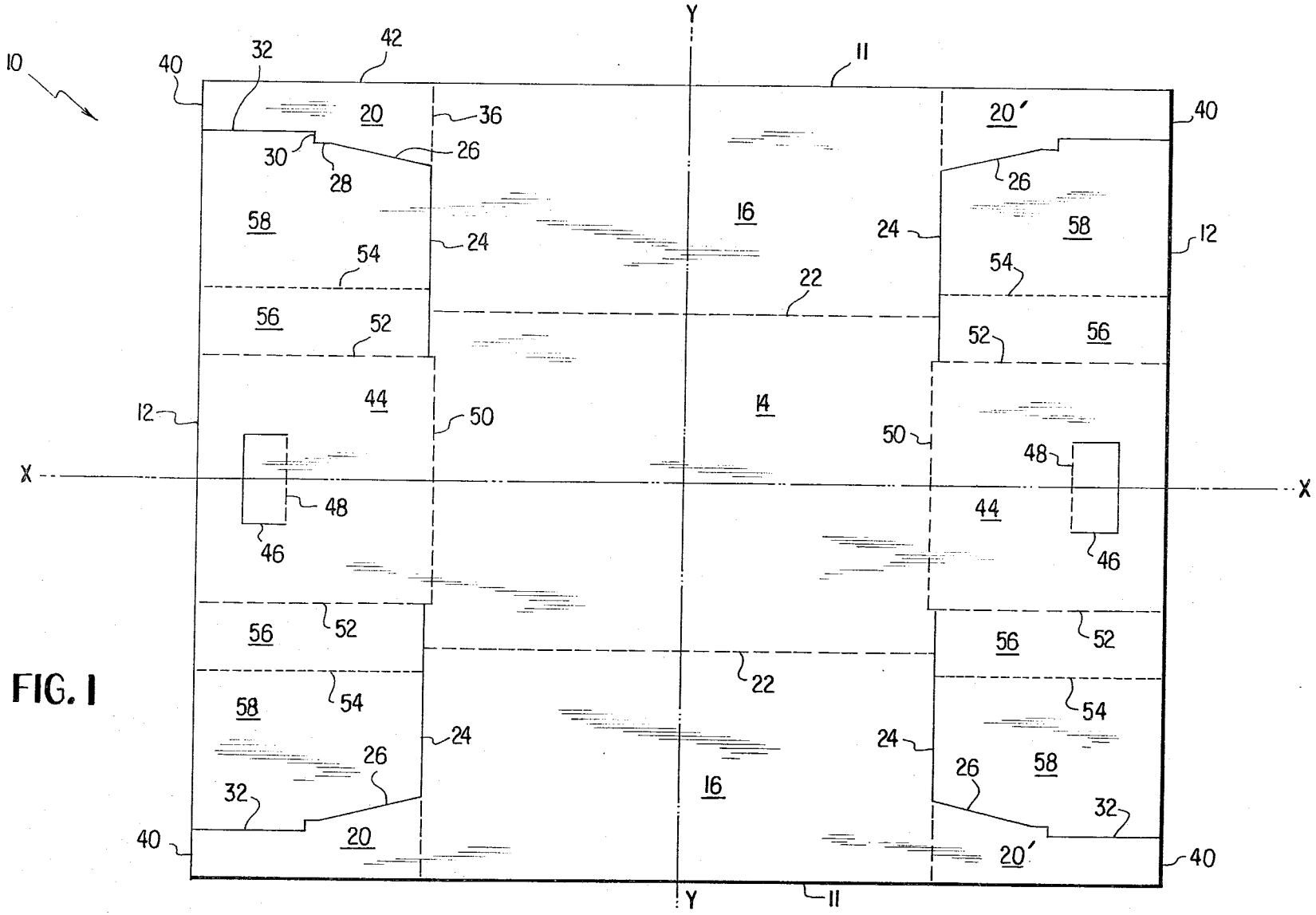

Referring now to FIG. 1 of the drawings, the numeral 10 denotes generally a one-piece blank from which the tray of this invention is formed. The blank is generally rectangular having top and bottom horizontally extending edges 11 and left and right vertically extending edges 12. It will be understood that the terms horizontal and vertical are used for the convenience of the reader in the description of the blank, the term horizontal denoting an imaginary axis X—X of FIG. 1 running horizontally with another imaginary axis Y—Y running vertically, also medially of the blank.

The numeral 14 denotes a central panel which is adapted, when the blank is folded, to form the bottom of the tray. The numeral 16 denotes the base of a T-shaped panel having a left bar 20 and a right bar 20'. The bars 20 and 21' define the top of the T-shaped panel, while the central and lower portions of panel 16 constitute the base. The reader will observe that the blank exhibits mirror symmetry about the horizontal axis X—X and the vertical axis Y—Y.

The numeral 22 denotes score lines which define the upper and lower edges of panel 14. The numeral 24 denotes cut lines which define the sides of the base of panel 16. The numerals 26, 28, 30 and 32 denote cut lines commencing from the top of score line 24 and extending in the indicated manner to the left edge 12 of the blank. The numeral 36 denotes a score line extending from each side of the base of panel 16, these score lines being, respectively, co-linear with their associated cut lines 24.

The numeral 40 denotes the endmost portion of the bars of T-shaped panels 16, these ends extending to the right and left edges of the blank.

The numeral 44 denotes either of two end panels which are adapted to form the end walls of the tray. Panels 44 are provided with cut lines 46 and a score line 48 adapted to form hand receiving openings. The numeral 50 denotes a score line at each left and right edges of central panel 14. The numeral 52 denotes horizontal score lines which run from the left and right edges of the blank inwardly and meet at the ends of respective score lines 50. The numeral 54 denotes horizontal score lines, parallel to score lines 52, running from the left and right edges of the blank to respective cut lines 24. Panels 56 are defined by score lines 52 and 54, cut lines 24, and the left and right edges of the blank. The numeral 58 denotes either of two top and bottom extensions of end panels 44, panels 56 and 58 being thus integral with panels 44.

From the description above, it will be observed that the general form of the several panels in blank 10 is that of a central panel, being panel 14, bounded on its upper and lower edges by generally T-shaped panels 16 and bounded on its left and right edges by end forming panels 44, the latter having integral extension 56 and 58. The reader will also observe that an imaginary axis defined by colinear score lines 36 and cut lines 24 is displaced from and generally parallel to each score line 50.

Figure 2:
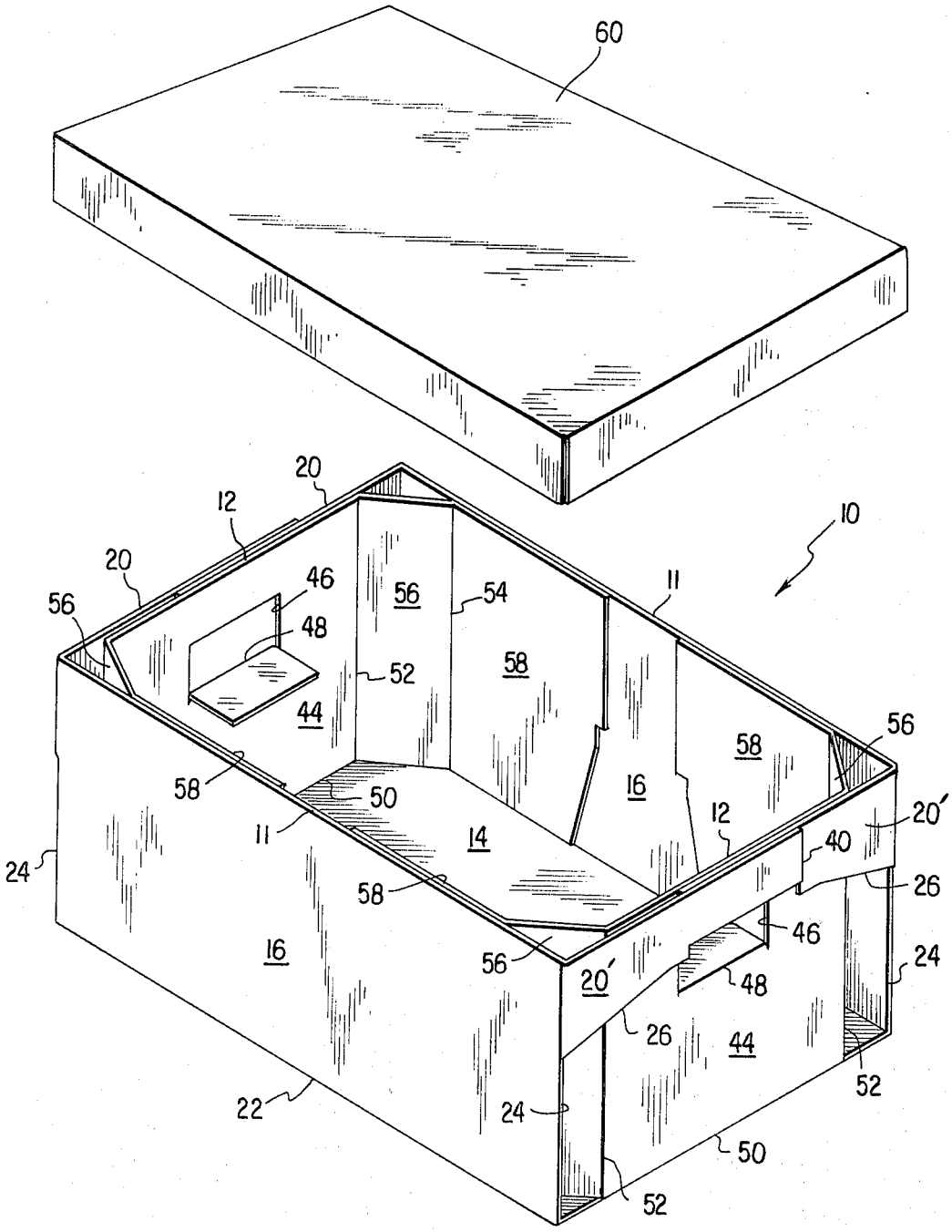
FIG. 2 is a perspective view illustrating a tray in the erected condition as formed from the blank of FIG. 1.

Referring now to FIG. 2 of the drawings, a container and lid is illustrated, the container being assembled from the blank shown at FIG. 1. To assemble the container from the blank, end panels 44 are folded inwardly about score line 50, with extension panels 56 and 58 being bent along score lines 52 and 54, respectively. Next, side panels 16 are folded upwardly about score lines 22 until they are substantially vertical. Thereafter, bars 20 and 20' are folded about score line 36 on the outside of the end panels 44. Lastly, the hand hole flaps are bent inwardly along score lines 48. As shown at FIG. 2, the panels 56 form 45° angles within panel 44 and extension panels 58. Bar members 20 and 20' overlap each other and may be held together as by an adhesive or by stapling. Similarly, extension panels 58 may be held to side panels 16 by an adhesive or by stapling. A similar means may be employed to fasten top portions of end panels 44 to the overlapped bar portion 20 and 20'. If desired, a cover 60 may be employed in connection with the tray of this invention, the cover being denoted in FIG. 2 by the numeral 60.

The container illustrated at FIG. 2 exhibits great resistance to vertical loads and is accordingly susceptible of sustaining heavy stacking loads. The structural elements defined at the four corners by panels 66 and the associated corners defined by side panels 16 and bar panels 20 and 20' add significantly to the vertical rigidity and structural integrity of the tray.

Figure 3:
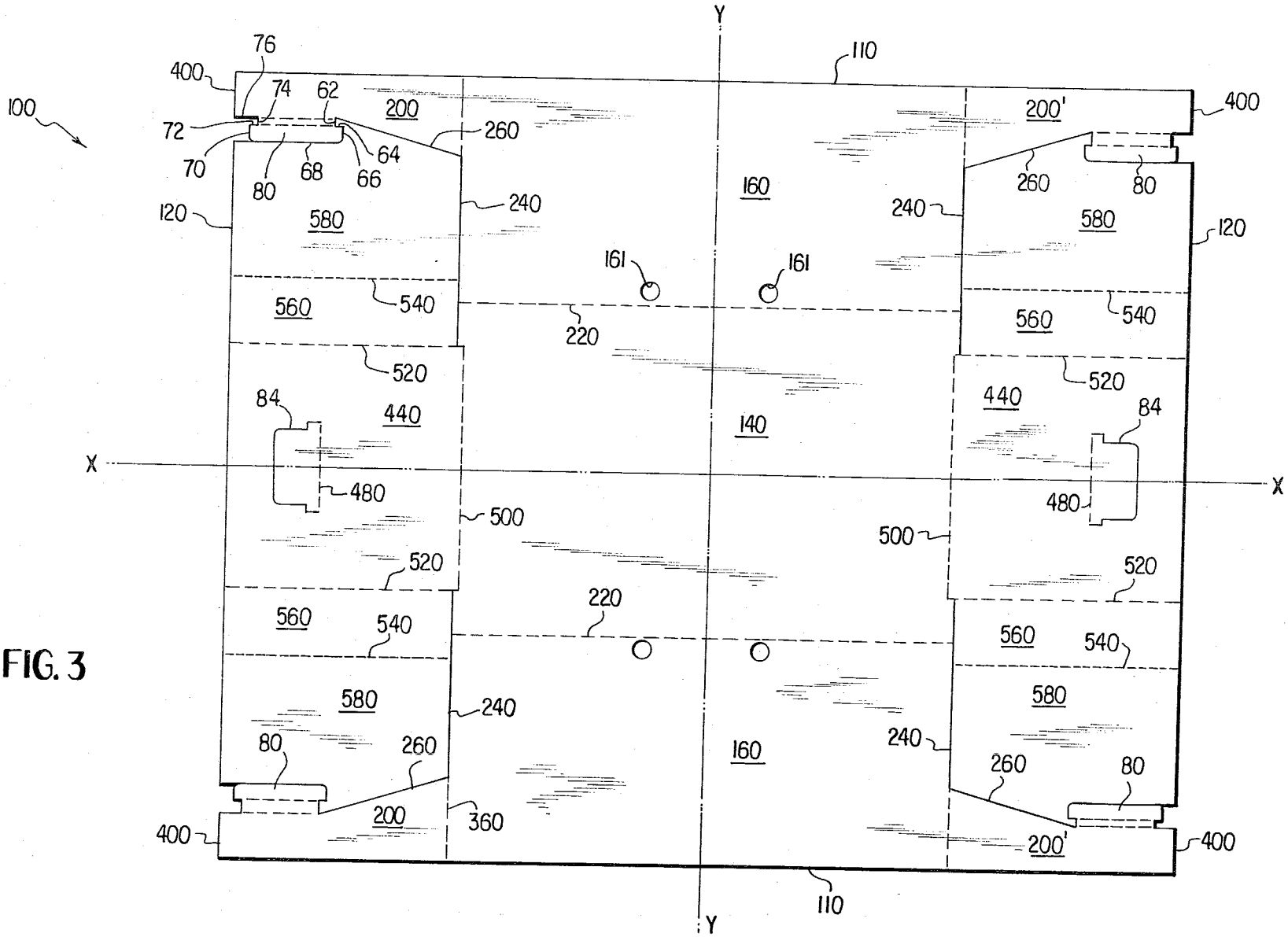
FIG. 3 is a view similar to that of FIG. 1, and illustrates a second embodiment.

Referring now to FIG. 3 of the drawings, a modification of the invention is illustrated, FIG. 3 showing the blank from which this modification is formed. The numerals which correspond to the numerals in the embodiment of FIG. 1 have been multiplied by a factor of 10, thus, the central panek 14 of the embodiment of FIG. 1 is designated by the numeral 140 in FIG. 3. Different numerals are used for elements of FIG. 3 which are of different form than those of the embodiment of FIG. 1.

The reader will observe that the blank of FIG. 3 also exhibits mirror symmetry both about a median, horizontal axis X—X and a similar vertical axis Y—Y. The blank is of the same general form, namely, a central blank 140 carrying at its upper and lower edges a generally T-shaped panel 160 and carrying at its sides a pair of end panels 440 which, when the blank is folded and assembled, form the ends of the tray. The essential difference between the construction of the blank of FIG. 1 and that of FIG. 3 is that in the latter the ends of the bars of the generally T-shaped panels are of a different form. This difference in configuration will now be described.

The numerals 62, 64, 66, 68, 70, 72, 74 and 76 denote cut lines which form a locking tab 80 integral with end bars 200 and 200' of the generally T-shaped panel members 160. These locking tabs exhibit a somewhat narrowed neck portion defined by cuts 62 and 74, with the indicated score lines between the cuts running parallel. Also, while the hand hold forming cut and score lines are generally the same, the form is somewhat different, these being defined by vertically extending score lines 480 (being similar to score line 48 of FIG. 1) and a different form of cut line, here denoted by the numeral 84. Further, draining openings 161 may be provided in panels 160.

Figure 4:
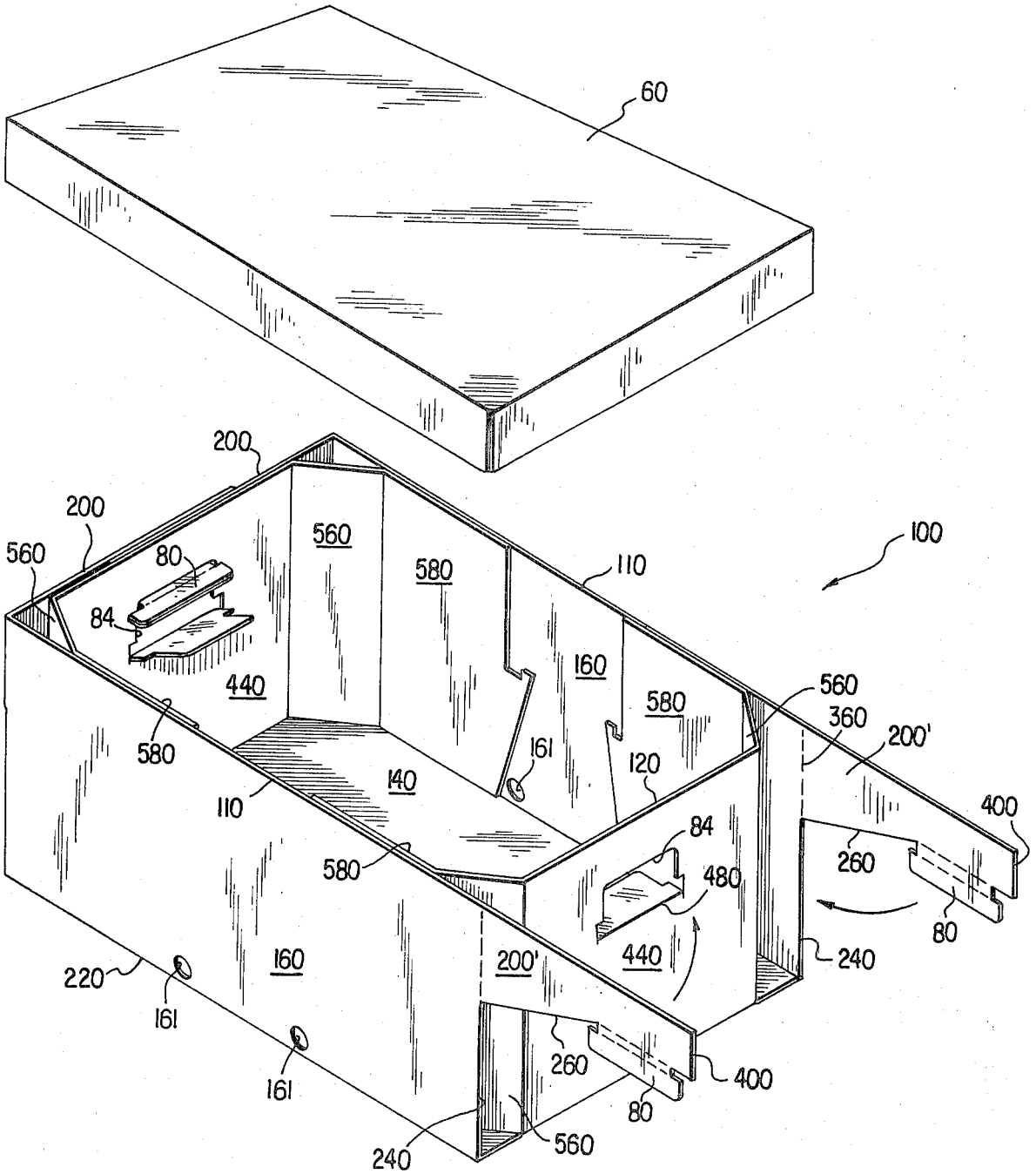
FIG. 4 is a view similar to FIG. 2, illustrating the erected tray according to the second embodiment.

Referring now to FIG. 4 of the drawings, the tray formed from the blank of FIG. 3 is illustrated. The mode of assembly is substantially the same as that previously described. First, end panels 440 are folded about score lines 500, with panels 560 and 580 being folded about score lines 520 and 540, respectively. Next, side panels 160 are folded upwardly about score lines 220 to a vertical position, with the subsequent folding inwardly, as indicated by the curved arrows at FIG. 4, bar portions 200 and 200' about score lines 360. The tabs 80 of overlapping bar portions 200 or 200' are pushed through the hand hole openings to assume the position indicated at the left hand portion of FIG. 4 of the drawings. It will be observed that the locking tabs 80 secure the bar members 200 and 200' in the desired and assembled position, with the widest part of the locking tabs 80 passing through the lower portion of the hand hole openings, with the subsequent upward movement of the neck portion along a narrowed portion of the hand holes. If desired, panel portions 580 may be secured to the side wall panels 160 by adhesive means or by stapling. Similarly, if desired and in addition to the locking action of tabs 80, bar members 200 and 200' may be stapled or adhesively secured to end panels 440. Again, a lid or top 60 may be employed. The tray of FIG. 4 exhibits the same desirable structural integrity as exhibited by the embodiment of FIGS. 1 and 2.

What is claimed is:

1. A one-piece blank of stiff, resilient and foldable material such as corrugated paperboard, the blank being adapted to be folded into a tray, the blank being of generally rectangular form, the blank having a plurality of score lines and cut lines, the blank having a central bottom forming panel (14) defined by and bound on its upper and lower edges by score lines (22) and on its left and right edges by both cut and score lines (24, 50), the upper and lower edges (22) of said central panel (14) each carrying a generally T-shaped panel (16, 20, 20') whose base (22) is positioned at a respective edge of the central panel and whose bare ends extend toward the right and the left edges (12', 12) of the one piece blank, each T-shaped panel being defined by cuts (24, 26, 28, 30, 32) extending along the sides of the base (16) of each T-shaped panel and running laterally away from it, the top (11) of each T-shaped panel extending along and being coincident with a respective end forming panel (44), the latter defined by said cuts (24, 26, 28, 30, 32), each end forming panel joined to a respective right or left edge of said central panel at the said central panel score lines, one edge of each of said end forming panels being coincident with a respective right or left edge portion (12', 12) of the one piece blank, the sides (24) of the base of each T-shaped panel (16) being non-colinear with the score lines (50) at the left and right edges of the central, bottom forming panel (14).

2. The one-piece blank of claim 1 wherein the end forming panels (44) are provided with score lines (52) running from a respective right or left edge (12) of the one-piece blank to the respective ends of the score lines (52) at the left and right edges of said central panel.

3. The one-piece blank of claim 2 wherein score lines (36) extend from respective upper and lower edges of the one-piece blank to the upper ends of those score lines (24) which define the sides of the base of each T-shaped panel to thereby define the two laterally extending bars (20) of each T-shaped panel.

4. The one-piece blank of claim 3 wherein the bar ends of the T-shaped panels extend to, respectively, the right and left edges of the one-piece blank.

5. The one-piece blank of claim 3 wherein the end forming panels (44) are each provided with means defining a hand hole, and wherein the bar ends of the T-shaped panel are provided with means to interlock said ends with and into the said hand holes when the blank is erected to form a tray.

6. A tray including bottom, side and end walls, the tray being fashioned from a one-piece blank of stiff, resilient and foldable sheet material such as paperboard, the side walls each carrying bar extensions which wrap around and overlie the end walls and which overlie each other, the end walls carrying panels which extend at an angle to the planes of the end and side walls and which also extend parallel to and in surface contact with the side walls, a hand hole in each of the end walls, the overlapping bar extensions of the side walls having lower edges which are coincident with the upper edges of the hand holes.

7. The tray of claim 6 wherein the overlapped bar extensions of the side walls each carry locking tabs, the locking tabs overlying each other and extending through said hand holes and being locked therein to thereby assist in maintaining the tray in an erected configuration.

* * * * *